US005440979A

United States Patent [19]

Bonham et al.

[11] Patent Number: 5,440,979

[45] Date of Patent: Aug. 15, 1995

[54] MAIL STAMPING APPARATUS AND METHOD

[75] Inventors: Richard E. Bonham, Scotland; Douglas C. Sooley, Waterloo, both of Canada

[73] Assignee: Z Mark International, Inc., Markham, Canada

[21] Appl. No.: 151,032

[22] Filed: Nov. 12, 1993

[30] Foreign Application Priority Data

Nov. 16, 1992 [GB] United Kingdom ..... 9224016

[51] Int. Cl.[6] ..... B41L 47/46

[52] U.S. Cl. ..... 101/91; 400/579; 400/630; 271/228; 271/259; 271/261; 209/900

[58] Field of Search ..... 209/900; 271/226, 258, 271/259, 261, 265, 266, 227; 400/634, 579, 630, 632, 633, 703, 709; 101/91, 93

[56] References Cited

U.S. PATENT DOCUMENTS

| | | | |
|---|---|---|---|
| 3,186,708 | 6/1965 | Hinz | 271/259 |
| 3,948,170 | 4/1976 | Ericsson | 271/261 X |
| 4,398,458 | 8/1983 | Denzin et al. | 101/91 |
| 4,643,089 | 2/1987 | Salazar et al. | 101/91 |
| 4,733,226 | 3/1988 | Kasuya et al. | 209/900 X |
| 4,765,239 | 8/1988 | Ciccone et al. | 101/91 |
| 5,000,088 | 3/1991 | Cargill | 101/91 |
| 5,035,415 | 7/1991 | Lee et al. | 271/259 X |
| 5,302,948 | 4/1991 | Lau et al. | 209/900 X |

FOREIGN PATENT DOCUMENTS

| | | | |
|---|---|---|---|
| 1006045 | 3/1977 | Canada . | |
| 1216065 | 12/1986 | Canada . | |
| 1240552 | 8/1988 | Canada . | |
| 1283809 | 5/1991 | Canada . | |
| 3222395 | 1/1983 | Germany | 271/259 |
| 3710161 | 10/1988 | Germany | 271/259 |

OTHER PUBLICATIONS

Xerox Disclosure Journal, vol. 9, No. 6, Nov./Dec. 1984; "Sheet Size Sensor".

*Primary Examiner*—Chris A. Bennett

*Attorney, Agent, or Firm*—Cushman, Darby & Cushman

[57] ABSTRACT

Method and apparatus for the cancellation of stamps and printing of pre-programmable messages on envelopes. The apparatus comprises structure for feeding a plurality of envelopes in singulated manner to a sensing assembly, which detects the leading and top edges of the envelope and trigger printing structure which cancels the stamp and/or prints on a pre-programmable message. The apparatus and method is of value when envelopes of different sizes, generally having the stamp in a common region, i.e. upper right-hand corner, as part of the plurality of envelopes are present.

8 Claims, 4 Drawing Sheets

MAIL STAMPING APPARATUS AND METHOD

FIELD OF THE INVENTION

This invention relates to apparatus and methods for the stamping of documents and more particularly to the cancellation of stamps and printing of tracking data on mail envelopes in postal systems.

BACKGROUND TO THE INVENTION

Methods of cancelling postage stamps affixed to envelopes passing through modern postal sorting facilities involve the rapid, automatic feeding of envelopes, letters and the like in singular file, termed singulated mail, with the envelopes passing vertically along a conveyor system with the stamp-bearing faces of the envelopes facing the same way with the stamp to be cancelled located at an upper corner thereof.

In such a stamp cancelling system, the address and postal code are read by, typically, face reading means such as a multiline optical character reader (MLOCR) and a machine readable fluorescent bar code is sprayed on to a front face of the envelope printed either in black, fluorescent or phosphorescent ink at a predetermined area on the face with reference to the lower and leading edges. This is accomplished by detection of the leading edge by optical sensing means and printing of the bar code at a pre-selected height on the envelope.

In both of the above methods, reading of the postal code by the MLOCR enables a pre-programmed sort by automatic reading and memorization of the code and the envelopes to be subsequently sorted into individual sort components of a letter sortation machine (LSM). A LSM may, typically, have 150 or more compartments. The envelope contents of these compartments may then be subdivided, either at the same or different postal site, into a sorted and arranged manner for direct use by the mail delivery person.

In addition to initiating the reading of the postal code by the MLOCR, the leading edge detection means triggers a printer to stamp the envelope for cancellation of the stamp purposes. The printer is set to effect cancellation of the stamp at the expected location of the stamp. However, such prior art printing methods and apparatus operate on the assumption that all pieces of mail, commonly envelopes, are approximately of the same size with their stamps located in the same general region on the face of the envelope, i.e. adjacent the upper right-hand corner. Unfortunately, such stamp location assumptions are not always correct and significant numbers of self-adhesive postage stamps do not get cancelled and the envelopes delivered to individual mailing addresses bearing non-cancelled stamps. In consequence, the stamp may be removed and reused. Also, people are re-using indicia-marked envelopes. Such action has been estimated to cost the national postal authorities significant losses in postal revenues.

A further problem existing in the postal delivery field is the occurrence of disputes between receivers of the mail and mail senders as to the date of arrival at the receiver's mailing address. Such a dispute may arise as between the sender of invoices, bills, legal documents, notices and the like. Thus, the receiver may argue that the document arrived later than it actually did at the mailing address. Accordingly, means of evidencing that the mail processed through the incoming postal processing facility as to time, date, machine used and place of processing and sorting, could provide a very useful solution to this problem. In addition, this would assist in quality control tests conducted by the postal authorities to track and trace mail and provide internal management control. Thus, such a ready means of printing a pre-programmable message or other data on an envelope if readily and cheaply developed could provide significant benefits.

SUMMARY OF THE INVENTION

Thus, the present invention provides a method and apparatus of cancelling a stamp on an envelope in a rapid, automatic stamp cancellation system whereby the stamp is cancelled by printing thereon, notwithstanding the presence of irregularly shaped envelopes in the system, provided the stamp is present in the usual, generally defined area of the envelope. This is achieved by the present invention, notwithstanding the high speed of transfer of the envelopes along the conveyor system and the limited amount of time available to adequately detect and cancel the stamp. A postal conveyor system typically runs at a speed in excess of 3.5 meters per second, to process 30–40 thousand envelopes per hour and thus providing approximately 0.1 second for each envelope to be printed.

The invention further provides a method and apparatus for printing a desired pre-programmable message in a desired location on an envelope in a rapid, automatic mail sorting system, notwithstanding irregular shaped envelopes or envelopes of different sizes are fed in singulated manner.

Thus, in an assembly for the rapid, automated identification, stamp-cancelling and sorting of a multiplicity of envelopes, said envelopes having a first edge, a second edge, a face, a mailing address on said face and a postage stamp proximate to said first edge and said second edge on said face, said assembly comprising first edge sensing means adapted to interact with a first edge of a first envelope;

envelope transfer means for providing said envelopes in singulated file to said first edge sensing means; and print means for printing characters on said face and facing said face and in communication with said first edge sensing means whereby when said first sensing means interacts with said first edge of said first envelope, said print means prints said characters on said face of said first envelope, the improvement comprising second edge sensing means in communication with said print means whereby activation of said first edge and said second edge sensing means by first edge and said second edge, respectively, causes said print means to print said characters on said face at a preselected region of said face relative to said first edge and said second edge.

Preferably, said first edge is the leading edge of the envelope and said second edge is the top edge of the envelope when the envelopes are transferred along the assembly in vertical singulated file.

Sensing the presence and height of an envelope can be done using, for example, passive optical sensors, one for each position, or a spray array of active optical sensors, wherein two are needed for each set in the array, such that if they get out of line the machine goes down, or optical imaging equipment to detect the stamp per se.

In several embodiments of the invention, the second edge sensing means comprises a sensing array comprising a plurality of individual sensing means, preferably constituting the first edge sensing means. Thus, the dual-purpose first and second sensing array may be arranged, for example, in either vertical alignment or in echelon.

Although the print means of use in the practice of this invention may constitute envelope contacting means, such as a print wheel, preferably, the print means comprises a plurality of ink jet spray print heads arrayed in a print assembly to provide means for applying characters and markings on the envelope face at pre-selected heights on the envelope. Thus, the invention preferably includes means for selecting the appropriate print head for printing under the influence of first edge and second edge sensing means to provide printing in the same general location relative to the first and second edges of the envelope.

In a further aspect, the invention provides a process for cancelling stamps and, optionally, printing pre-programmable characters on the face of an envelope using the apparatus as hereinabove defined.

Accordingly, the invention further provides a method for the rapid, automated identification, stamp-cancelling and sorting of a multiplicity of envelopes, each of said envelopes having a first edge, a second edge, a face, a mailing address on said face and a postage stamp proximate to said first edge and said second edge connected to said face, said method comprising:

transferring said envelopes in singulated file to a first edge sensing means;

sensing said first edge by said first edge sensing means;

printing characters on said face at a pre-selected region of said face relative to said first edge in consequence of said first edge sensing, the improvement comprising sensing said second edge by a second edge sensing means and printing characters on said face at said pre-selected region in consequence of said first and said second edge sensing.

The term "stamp" in this specification and claims includes pre-printed indicia.

DESCRIPTION OF PREFERRED EMBODIMENTS

In order that the invention may be better understood, preferred embodiments will now be described by way of example only, with reference to the accompanying drawings in which like numerals denote like parts throughout the several views, and wherein.

Figure 1:
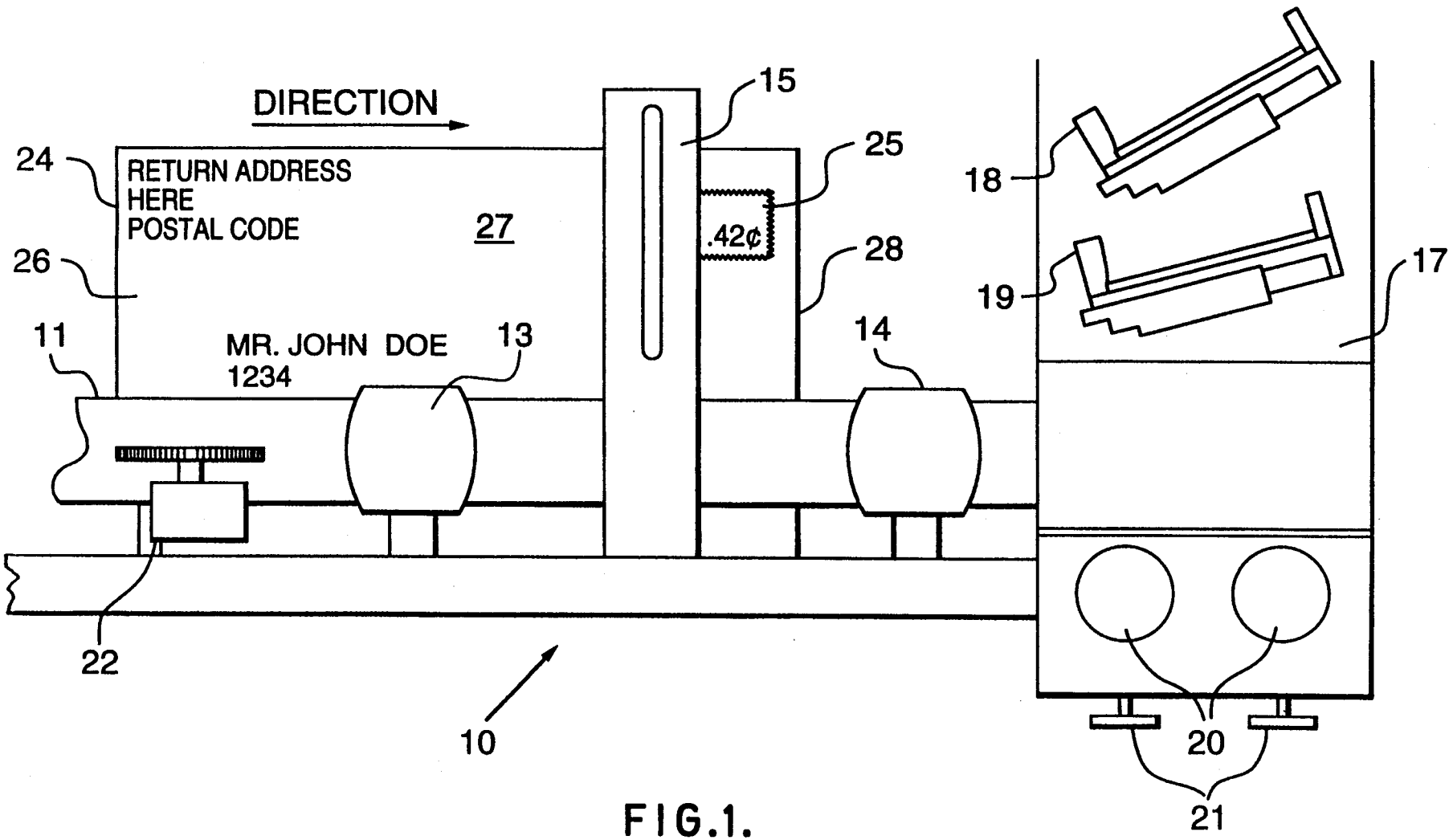
FIG. 1 is a somewhat schematic side elevational view of the major components of part of a stamp cancelling and pre-programmable message printer assembly according to the invention co-operating with an envelope.
Figure 2:
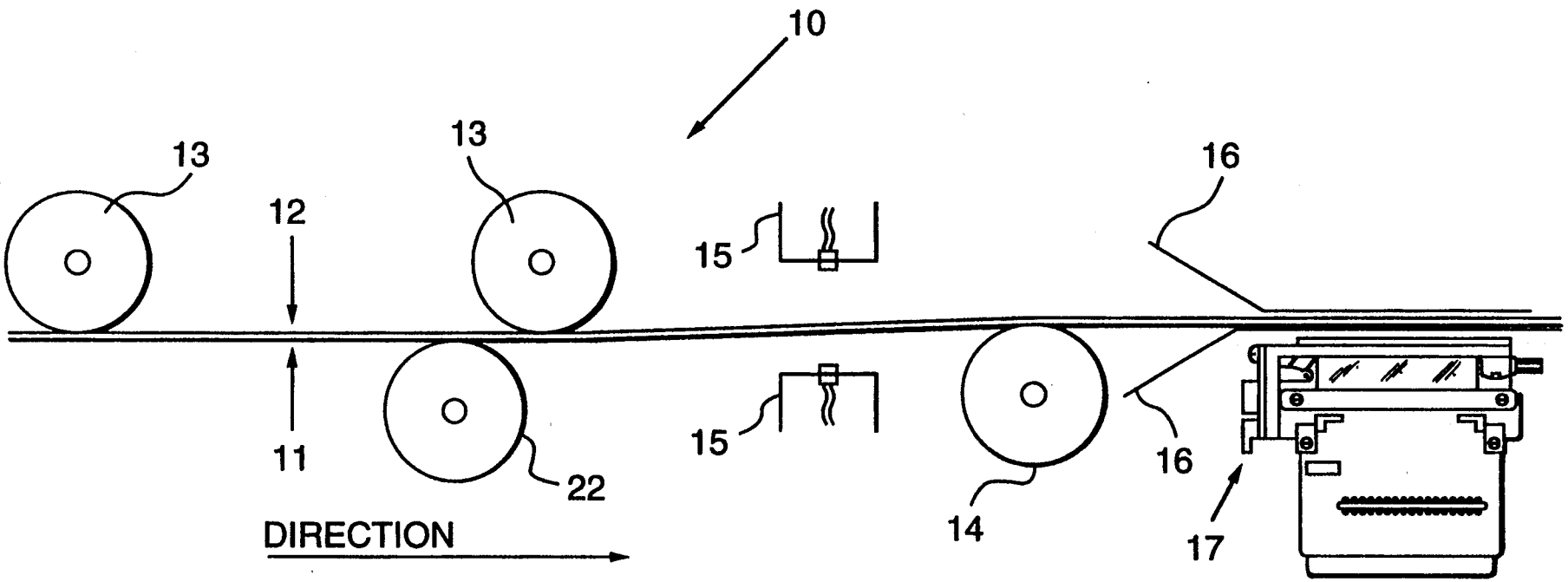
FIG. 2 is a schematic plan view of major components of an assembly according to the invention.

With reference to FIGS. 1 and 2, a stamp cancelling and programmable message printer assembly according to the invention, shown generally as 10, comprises letter transfer belts 11, 12 of a letter conveyor system, idler rollers 13, 14, fibre optic sensors 15 aligned in vertical array, printer guides 16 and a print head array shown generally as 17. Array 17 has a bank of individual ink jet spray heads. In the embodiment shown two spray-heads are provided, namely, upper print spray head 18 and lower print spray head 19, arranged vertically 18 above 19. Array 17 has mounting adjustments 20 and locking bowls 21. Disposed ahead of sensor 15 is a wheel encoder 22. Encoder 22 may be located anywhere adjacent the transport belt near the printer to monitor the speed of the transport.

With particular reference to FIG. 1, assembly 10 acts upon vertically aligned envelope 24, which has postage stamp 25 mailing address 26 on face 27, and leading edge 28 and bottom edge (not shown).

Figure 4:
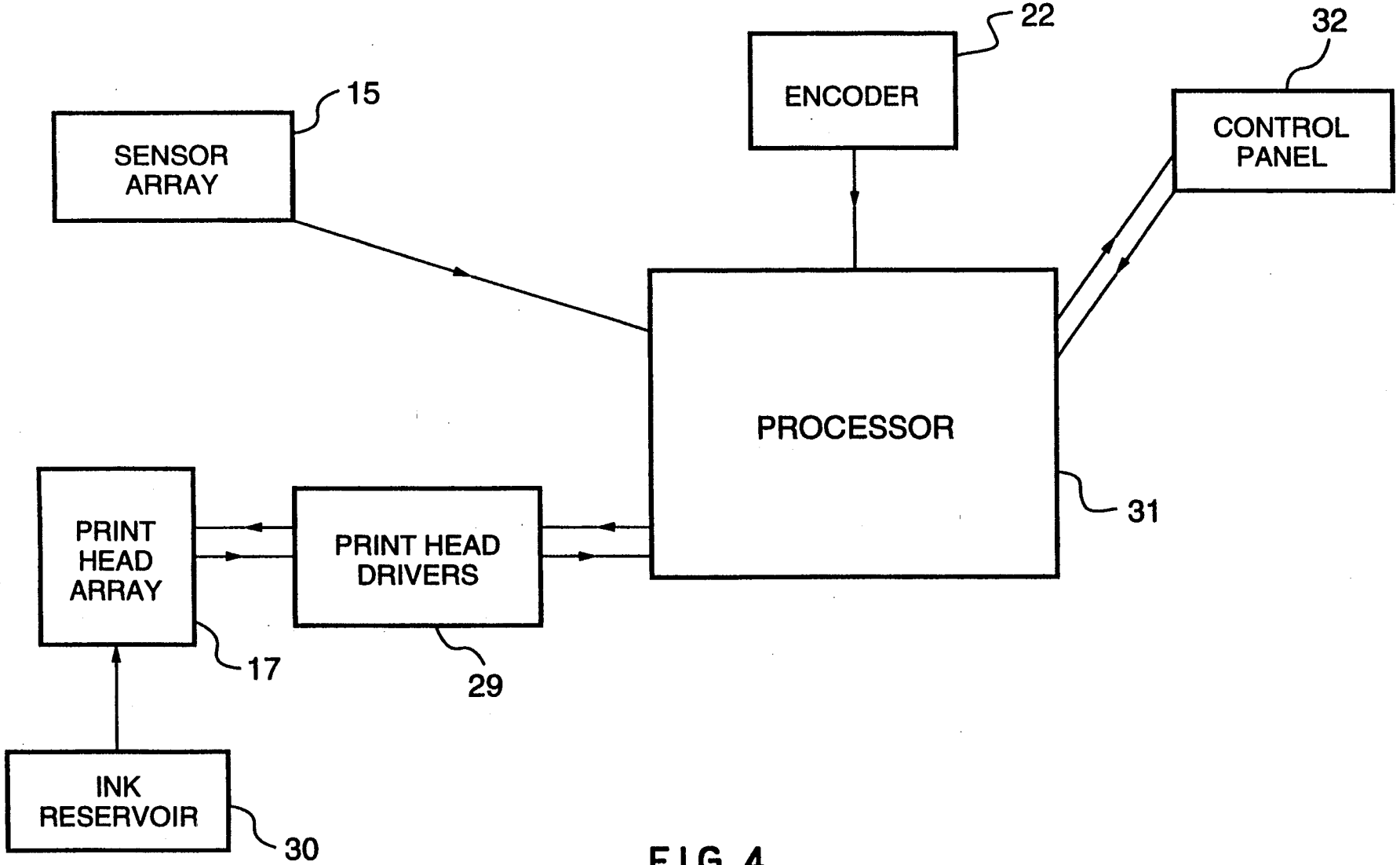
FIG. 4 is a Schematic block diagram layout of electronically operated units of an assembly according to the invention.

With reference also to the electronically operated units of FIG. 4, array 17 co-operates with print head drivers 29 and is fed with ink from reservoir 30. Sensor array 15 and encoder 22 interface with processor 31 under the control of panel 32.

Figure 3:
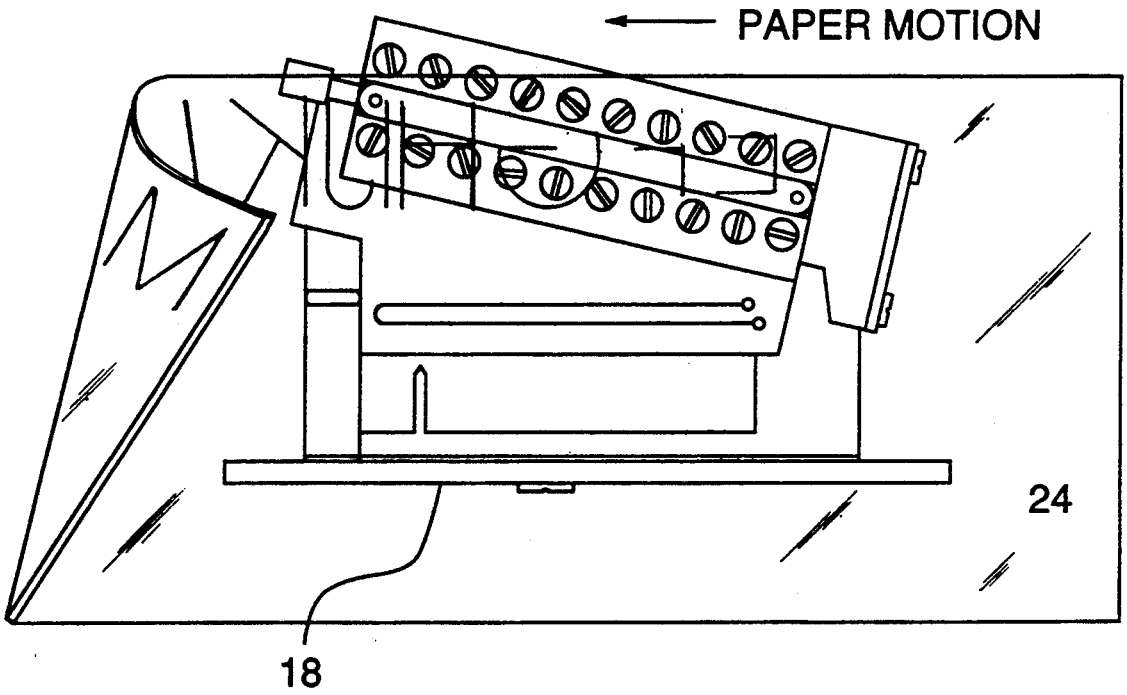
FIG. 3 is a diagrammatic side view of a prior art ink jet printer of use in the practice of the invention.

With specific reference to FIG. 3, heads 18, 19 of use in the assembly described hereinabove are commercially available. Each of 18, 19 has a 32-channel array wherein each channel is identical and shares a common ink supply manifold. Preferably, the array is mounted to the reservoir at an angle of 15° from the horizontal. Print characters up to one centimeter in height can be formed by controlling the firing timing of the channels. A slant shape (not shown) controls the timing of droplet ejection to allow the user to input the font as if the head was completely vertical. Each of the 32 channels of each Of the heads 18, 19 has a piezoelectric inducer located therein. Ejection of printing ink from each channel of heads 18, 19 occurs at a velocity proportional to the voltage applied to the transducer. Average velocity of the ink is 11 meters per second.

In operation, envelope 24 passes between belts 11, 12 at a speed of approximately 3.5 meters per second with its bottom edge riding on top of the assembly table (not shown). Envelope 24 passes encoder 22, which provides timing for the printing and tracking of the envelope to processor 31. Envelope 24 continues between sensors 15 which detect the upper and leading edges of envelope 24 and feeds this information to processor 31. Control panel 32 provides the user interface and permits selection of desired user programmable messages to be ink jet sprayed by head 18 or 19, as the case may be, on to envelope 24. Control panel 32 additionally controls the starting and stopping of assembly 10. Processor 31 in consequence of the input from sensors 15 determines the location on envelope 24 of the message to be sprayed and determines which of printers 18, 19 is to be activated to effect such spraying in the region relative to the upper and lower edges where the stamp is expected to be located. Additionally, processor 31 keeps track of the time, date, number of envelopes 24 processed and interfaces with drivers 29 to provide the electronic signals and controls for heads 18, 19.

Figures 5, 6:
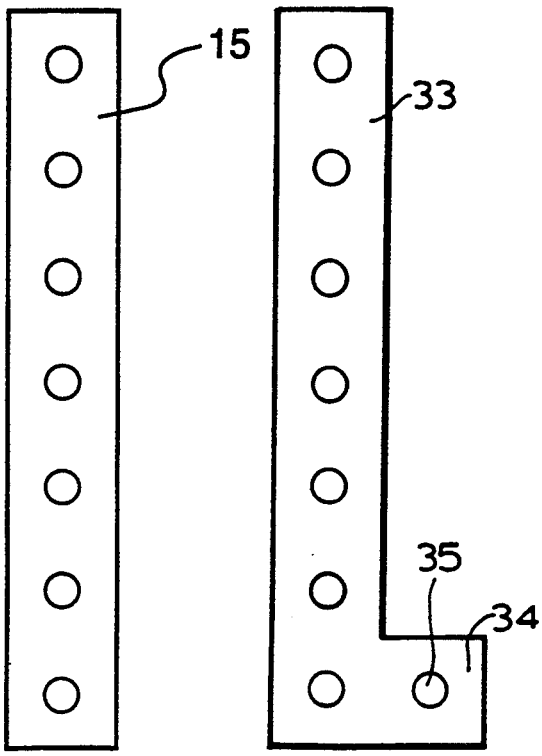
FIG. 5 represents a diagrammatic elevational view of a vertical array of edge sensors of use in the practice of the invention.
FIG. 6 represents a diagrammatic elevation view of a vertical array of edge sensors and an additional right offset bottom sensor of use in the practice of the invention.

With reference to FIGS. 5 and 6, sensing means 15 and 33 detects the leading edge of envelope 24 and in addition, detects the height of the envelope by reason that the envelope interferes with the fibre optic provided light beam traversing the conveyer belt perpendicularly to the movement of belts 11, 12. Thus, the height at which the envelope ceases to interfere with the sensing receivers is passed to the processor 31 which provides instructions to either of 18 or 19 for appropriate activation to effect spray printing of the envelope at the pre-selected region. Clearly, this would be the upper right hand corner region of any reasonably sized envelope fed in singulated form along the assembly. The pre-programmed message printed across that stamp cancelling region may also extend beyond that region to extend the full length of the envelope, if desired.

With particular reference to FIG. 6, sensing means 33 comprises an array of individual edge sensors in vertical alignment and a further edge sensor 35 offset from the vertical array at a lower position 34 thereto. This eliminates the possibility of false detection of the upper edge of an envelope when it is skewed or cocked to the horizontal while passing through the canceller/tracker system. A false detection may cause the upper printer head to fire and partially, or even totally, miss the envelope. At the speed of operation and, particularly with intermixed sizes of mail, skewed envelopes in the transfer belt are common.

During operation, as time progresses, the date/time group stamp printed will change automatically chronologically as desired.

We have found that array 17 should preferably comprise a plurality of ink jet sprayers to provide precise and definite printed characters in the desired location, notwithstanding the rapid speed of operations and the minimal amount of time each envelope is available for proper programmable printing. However, it is understood that alternative modes of printing, involving mechanical movement of the print head to physically contact the stamp/envelope, such as a contact print wheel, falls within the concept of the present invention. Clearly, extremely rapid forward envelope face contacting actions of the selected print head is necessary.

While the invention has been described with reference to specific embodiments thereof, it will be apparent to one skilled in the art that various changes and modifications can be made therein without departing from the spirit and scope of the invention as described and claimed.

We claim:

1. In an assembly for the rapid, automated identification, stamp-cancelling and sorting of a multiplicity of envelopes, each of said envelopes having a first edge, a second edge, a face, a mailing address on said face and a postage stamp proximate to said first edge and said second edge connected to said face, said assembly including first edge sensing means for interacting with a first edge of a first envelope;

envelope transfer means for providing said envelopes in singulated file to said first edge sensing means; and print means for printing characters on said face and facing said face and in communication with said first edge sensing means whereby when said first sensing means interacts with said first edge of said first envelope, said print means prints said characters on said face of said first envelope, the improvement comprising:

second edge sensing means for interacting with a second edge of the first envelope and in communication with said print means whereby activation of said first edge and said second edge sensing means by said first edge and said second edge, respectively, causes said print means to print said characters on said face at a pre-selected region of said face relative to said first edge and said second edge.

2. An assembly as claimed in claim 1 wherein said second edge sensing means comprises an array comprising a plurality of individual edge sensing means.

3. An assembly as claimed in claim 1 wherein said second edge sensing means comprises said first edge sensing means.

4. An assembly as claimed in claim 2 wherein said second edge sensing means comprises an array comprising a plurality of individual first edge sensing means.

5. An assembly as claimed in claim 1 wherein said first edge sensing means operably senses the leading vertical edge of said envelope and said second edge sensing means operably senses the upper edge of said envelope.

6. An assembly as claimed in claim 5 wherein said first edge sensing means comprises an array of individual edge sensing means in vertical alignment and a further edge sensing means offset from said vertical array at a lower position thereto.

7. A method for the rapid, automated identification, stamp-cancelling and sorting of a multiplicity of envelopes, each of said envelopes having a first edge, a second edge, a face, a mailing address on said face and a postage stamp proximate to said first edge and said second edge connected to said face, said method comprising:

transferring said envelopes in singulated file to a first edge sensing structure;

sensing said first edge by said first edge sensing structure;

printing characters on said face at a pre-selected region of said face relative to said first edge in consequence of said first edge sensing, sensing said second edge by a second edge sensing structure; and printing characters on said face at said pre-selected region in consequence of said first and said second edge sensing.

8. A method as claimed in claim 6 wherein said sensing of said first edge and of said second edge is carried out by the same sensing means.

* * * * *

UNITED STATES PATENT AND TRADEMARK OFFICE

CERTIFICATE OF CORRECTION

PATENT NO. : 5,440,979

DATED : August 15, 1995

INVENTOR(S) : BONHAM, ET AL.

It is certified that error appears in the above-indentified patent and that said Letters Patent is hereby corrected as shown below:

On the title page, item"[73] Assignee: Z Mark International, Inc. Markham, Canada" to --[73] Asssignee: --Accu-Automation Corporation, Waterloo, Canada--

Signed and Sealed this

Thirtieth Day of July, 1996

Bruce Lehman

*Attest:*

BRUCE LEHMAN

*Attesting Officer*

*Commissioner of Patents and Trademarks*